US006672373B2

(12) United States Patent
Smyrnov

(10) Patent No.: US 6,672,373 B2
(45) Date of Patent: Jan. 6, 2004

(54) METHOD OF ACTION OF THE PULSATING HEAT PIPE, ITS CONSTRUCTION AND THE DEVICES ON ITS BASE

(75) Inventor: Genrikh Smyrnov, Denver, CO (US)

(73) Assignee: Idalex Technologies, Inc., Arvada, CO (US)

( * ) Notice: Subject to any disclaimer, the term of this patent is extended or adjusted under 35 U.S.C. 154(b) by 19 days.

(21) Appl. No.: 10/228,018

(22) Filed: Aug. 26, 2002

(65) Prior Publication Data

US 2003/0037910 A1 Feb. 27, 2003

Related U.S. Application Data

(60) Provisional application No. 60/315,393, filed on Aug. 27, 2001.

(51) Int. Cl.[7] ..... F28D 15/00

(52) U.S. Cl. ..... 165/104.26; 361/700; 174/15.2; 257/715

(58) Field of Search ..... 165/185, 80.4, 165/104.33, 104.26; 361/700, 699; 174/15.2; 257/715

(56) References Cited

U.S. PATENT DOCUMENTS

| | | | | | |
|---|---|---|---|---|---|
| 4,884,169 | A | * | 11/1989 | Cutchaw | 165/80.4 |
| 4,903,761 | A | * | 2/1990 | Cima | 165/104.28 |
| 4,921,041 | A | * | 5/1990 | Akachi | 165/104.26 |
| 5,219,020 | A | * | 6/1993 | Akachi | 165/104.26 |
| 5,303,768 | A | * | 4/1994 | Alario et al. | 165/104.26 |
| 5,725,049 | A | * | 3/1998 | Swanson et al. | 165/104.26 |
| 6,269,865 | B1 | * | 8/2001 | Huang | 165/104.26 |
| 6,450,132 | B1 | * | 9/2002 | Yao et al. | 165/104.26 |

* cited by examiner

*Primary Examiner*—Terrell McKinnon
(74) *Attorney, Agent, or Firm*—Jennifer L. Bales; Macheledt Bales LLP

(57) ABSTRACT

By construction of heat pipes with two phase heat carrying fluid, an efficient heat transfer system is available. The heating section is used to create, within the heat pipe, build up of vapor pressure which causes the heat carrying fluid to move which then allows for dissipations of the heat into the cooling section. Additions to the system allow for storage of kinetic energy to enhance or regulate the flow, and by introduction of heating elements or porous surfaces, the mechanic can be improved or regulated.

11 Claims, 8 Drawing Sheets

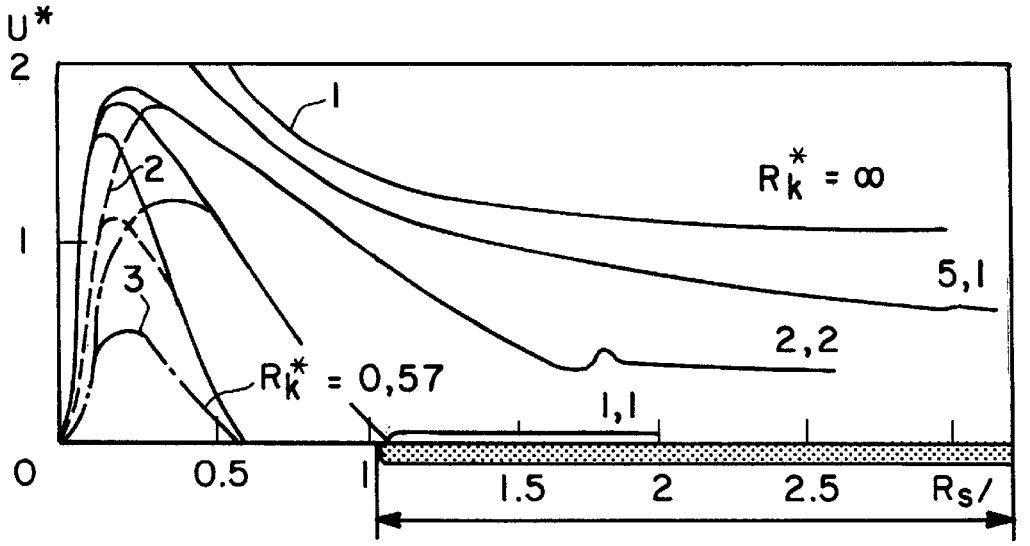

The stable field of the alternating vapor-liquid slugs, where R*k < 1.1 and R*sl> 1.

Here: R*k - the relative radius of a tube,
RK- the radius or equivalent radius of a tube,
R*sl - the relative equivalent radius of the vapor slug,
U* - the relative velocity of the vapor slub emersion,
U - the absolute velocity of the vapor slug emersion.

$$U^* = U/\sqrt{g\,\Delta\rho Rk}, \text{ where}$$

g - the gravitation acceleration,
$\Delta\rho$ - the difference of densities between of liquid and vapor of the heat carrier.

*Fig. 1a*

**The dependency of the bubble emersion from relative velocity U* in the vertical tube.**

METHOD OF ACTION OF THE PULSATING HEAT PIPE, ITS CONSTRUCTION AND THE DEVICES ON ITS BASE

RELATED APPLICATIONS

The applicant claims priority of Provisional patent application Serial No. 60/315,393, filed Aug. 27, 2001, entitled "THE METHOD OF ACTION OF THE PULSATING HEAT PIPE, ITS CONSTRUCTION AND THE DEVICES ON ITS BASE", inventor, Genrikh Smyrnov.

FIELD ON THE ART

The present invention relates generally to the method of heat transfer using a pulsating heat pipe (PHP), an apparatus and, for practical applications such as power engineering, chemical industry, heat recovery and ecological systems etc.

BACKGROUND OF THE INVENTION

The first pulsating heat pipe was described as pulsating heat pipe (PHP) in the former USSR in 1971 by Smyrnov G. F. and Savchenkov G. A. (see USSR patent 504065, filed Apr. 30, 1971). Smyrnov G. F. made use of his inventions in refrigerating devices (see USSR patents 730047 and 1722117). The inventor (Smyrnov) in his doctorate dissertation, discussed the theoretical aspects (see Smyrnov G. F. "The evaporative thermal control systems fundamentals", 1979. The thesis of Leningrad Institute of Refrigeration and Food Technologies.).

Lately, Akachi H. (Japan) suggested a new variant of the pulsating heat pipe constructions (U.S. Pat. Nos. 4,921,041, 5,219,020, 5,507,092, 5,642,775, 5,697,428). For example, in U.S. Pat. No. 4,921,041 Akachi H. wrote: ". . . heat pipe is disclosed in which a heat pipe carrying fluid, preferably a bi-phase noncondensative fluid, circulates in a loop form in itself under its own vapor pressure at a high speed within a pipe so as to repeat vaporization and condensation, thus carrying out a heat transfer." Hereinafter in variants of design of the pulsating heat pipes, Akachi H. wrote: "A check valve(s) propels and amplifies forces generated by the heat carrying fluid and its vapor to move towards the stream direction limited by the check valve(s) so that the heat carrying fluid circulates in the stream direction through the closed-loop passage defined by the pipe at the high speed, repeating vaporization at the heat receiving and radiating portions."

There are Limitations in the above Akachi Disclosures

1. Reliable start up of these devices independently of their position in the gravity field?

2. Differences in the forces, which ensure the stable movement of the two-phase flow of heat carrier?

Akachi's explanation of the check valve(s) role in the influence on the two-phase flow movement is: "A check valve propels and amplifies forces generated by the heat carrying fluid." This check valve allows flow in both directions under low flow conditions, but only in one direction with high flow. It is well known that a valve adds local hydraulic resistance, not forces to propel or amplify any forces. The Akachi patents outline that looped and non-looped pulsating heat pipes have the same method of action.

It is necessary also to note the inventions of Dinh K. (see U.S. Pat. Nos. 5,404,938, 5,845,702, and 5,921,315). He designed heat pipe heat exchangers on the base of the serpentine heat pipes. The practical application of these serpentine heat exchangers is for air conditioning systems, primarily, for improvement of the dehumidification process of cooling air. These devices consist of two parts (sections)—evaporation and condensation where there are the traditional refrigerants with considerable levels of pressure in the working regimes and also the traditional metallic materials for tubes with internal diameter considerable more than capillary sizes.

The following disclosure sets out the method and apparatus to accomplish efficient heat and mass transfer using the pulsating heat pipe, with stability and minimal mechanical components.

SUMMARY OF THE INVENTION

Object of the invention is to provide a pulsating heat pipe (PHP) method of action, construction and devices using these heat pipes. The suggested method of action of the PHP allows stability in processes of heat and mass transfer. The author's disclosure outlines previously unknown action and processes, which can improve and increase efficiency of PHP. In accordance with the claims of the invention, this object is achieved by providing in the PHP special and selected irregularity (non-uniformities) of the geometric and physical nature. These lead to thermo hydraulic differences and in heat and mass transfer coefficients improvements. Additionally, periodically acting driving forces are generated and can be used by the apparatus to produce stability in the operation in some of the embodiments.

Another object of the invention is to provide in some embodiments a PHP design, which can be inexpensive and convenient for manufacturing. The design uses simple elements in the PHP, as bellows, capillary inserts, and small elastic parts of the branches of a channel and others, which can increase the reliability of PHP. The thermo hydraulic features result in lowering the average temperature difference between the heating and cooling zones due to the PHP stability and reliability.

Still another object of the invention is to provide the devices that are compact heat exchangers with and without fins, which can work independently from gravitation and gravitational orientation, and different heat transfer modules for heat dissipation in various environmental media, including radiation in space etc.

BRIEF DESCRIPTION OF THE DRAWINGS

FIG. 1*a* illustrates the stable two-phase flow structures in the form of the liquid 4 and vapor 5 alternating slugs.

(FIG. 2*a*: lengths L1*c*, L2*c*, L1*h*, L2*h* . . . , pitches S1, S2, S3 . . . and FIG. 2*b*: radiuses R1, R2, R3 . . . ).

DETAIL DESCRIPTION OF THE SPECIFIC EMBODIMENTS

Figure 1:
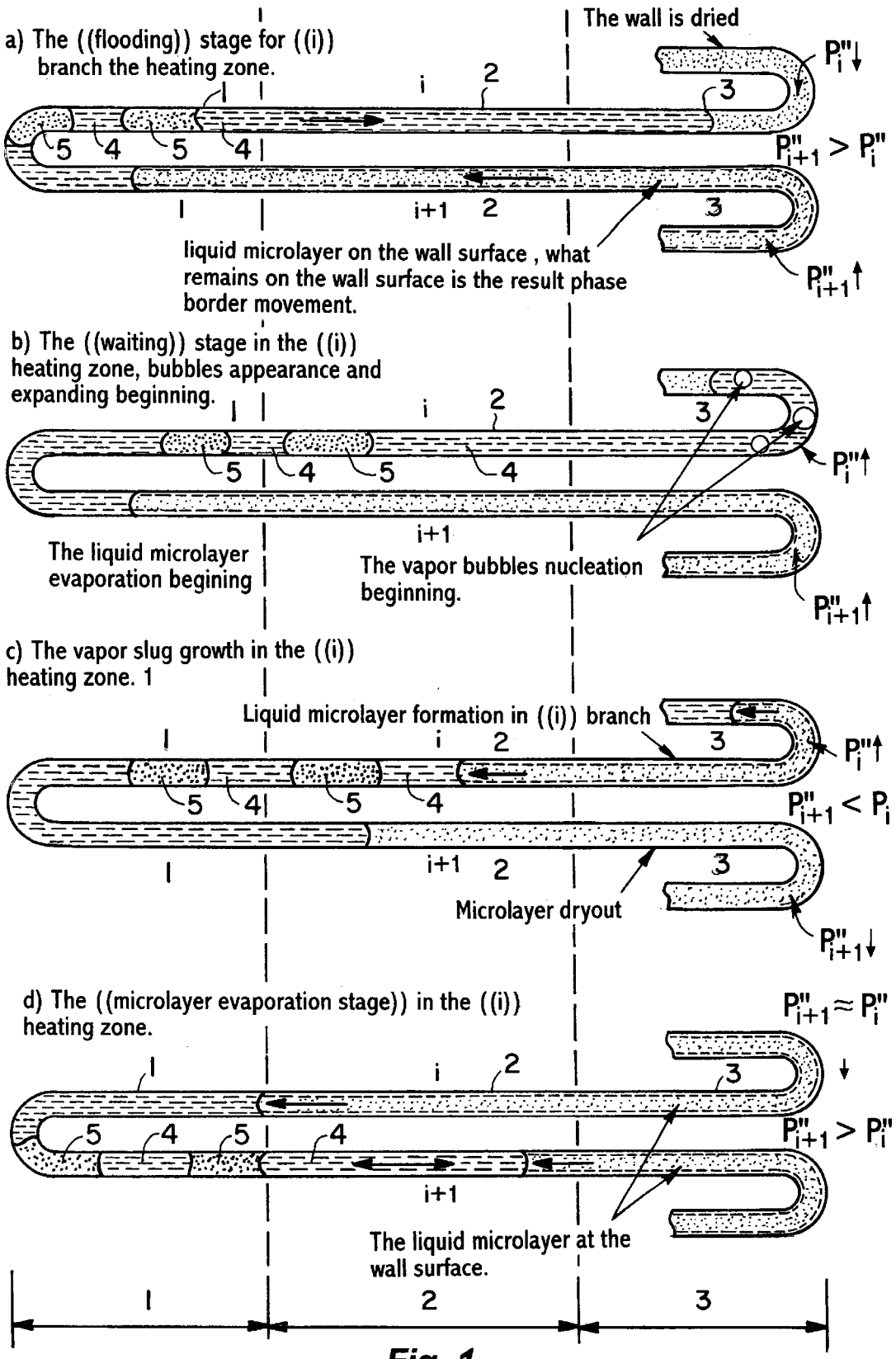
FIG. 1 illustrates the zones of hydrodynamic and thermal phenomenon, which take place in the elementary cell in the pulsating heat pipe (PHP) method of action, where: 1—cooling section (zone); 2—transport section (zone); 3—heating section (zone) with vapor zone growth in the heating section acting as the pulse force.

The present invention provides the following method of action of the pulsating heat pipe and structure, its construction and the application devices, (see FIG. 1):

1) Existence of "individual" and "joint" mechanisms of periodical movement of the two-phase heat carrier (working fluid) from the heating zone 3 to the cooling zone 1 and back to the heating zone 3.
2) Existence of a mechanism of periodical change of the heat transfer intensity both in the cooling 1 and in the heating zone 3 as the result of periodical movement. The driving pressure, (see 6. below) provides the periodical movement of liquid phase between the "hot" zone and "cold" zone.
3) The processes of liquid micro layer formation and destruction by evaporation in vapor slugs form the physical basis for the periodical changes of the heat exchange intensity.
4) The mechanism of heat transfer at which the following phenomena take place: heat transfer at "micro layer" location causing evaporation, creating a "dry" wall thermal mode accompanied by the wall temperature increase until the liquid moves and comes in contact with the wall.
5) "Individual" mechanism of the liquid's periodical movement to the heating zone 3 is determined by the behavior of vapor/liquid mixture periodically moving in an elementary cell of the PHP. An elementary cell consists of two neighboring branches.
6) The primary driving force causing pulsating fluid movement is determined by the micro layer evaporation and the resulting periodic liquid movement into i and (i+1) zones caused by changing pressure or the un-balanced pressure in the i and (i+1) zones.
7) In the "hot" zones relation to the gravity field (at the bottom or at the top), and the corresponding hydrostatic pressure will either increase or decrease the driving pressure of pulsing action. In the situation where the hot zone is on top, the driving force must counter act the gravitational forces during the initial moment the system is started up and the ongoing operation.

On some conditions, it can be found that the value of two-phase column hydrostatic pressure is considerably higher than the driving pressure value. In this case, the PHP will not be able to operate against the gravity. In another case (when the corresponding hydrostatic pressure will be lower than the driving pressure) the PHP will be able to operate against gravity. When the heating zone 3 is located at the bottom, the PHP will operate as a typical thermosyphon. The corresponding mathematical calculation models including the analysis of the thermal resistance of thermosyphon, that use Freon as the heat carrier, are correct based on the results of experimental data of the within invention. The data presented by Japanese inventor Akachi H. in his papers supporting his U.S. Pat. No. 4,921,041 titled "Thermo Performance of Capillary Tube Thermosyphon" by S. Maezawa, K. Gi, a. Minamisawa(1) and H. Akachi (2) given at the International Heat Pipe Conference in May 1995 in Albuquerque, N. Mex. is consistent.

The heat transfer modes can correspond to changes of heat and mass flow balance. The following phenomena are the main mechanisms of heat exchange modes:

1) Liquid microfilm evaporating in the heating zone 3, which causes the disappearance of the thin layer of liquid on the wall surface that is in contact with the vapor slug.
2) "Flooding" with liquid in the cooling zone caused by pressure increases in vapor slug due to the evaporation in (1).

In the cooling zone, flooding with liquid causes the "blockage" of much higher heat transfer. The liquid coats the wall, it then moves to the lower conduction heat transfer mode. The same conduction heat transfer takes place in the transport zone 2. Transport zone 2 wall and the liquid in this zone periodically accumulate heat when pressure at the saturation temperature increases and then rejects heat while the pressure decreases when the sub cooled liquid comes to the transport 2 and the heating 3 zones.

The PHP has several process stages that provide estimation of process duration, vapor quality and thermal resistance values as following:

1. Stages of "Heat application".
2. "Stage of flooding" with two-phase mixture.
3. "The stage of waiting", while heating zone three is dried.
4. "Stage of vapor phase increase".
5. "Stage of drying out".

The theoretical analysis considers every stage and zone, duration of time and average temperature drop. The results show acceptable qualitative and quantitative coincidence between the calculations and the experimental data.

The analysis shows that the periodically acting driving force caused by thermo hydraulics discontinuities (irregularities) connected with imbalance in the local vapor pressure inside vapor slugs as a result of the changing with time and location of the thin liquid film on the walls. The liquid film appears at different points in time in the adjoining branches allowing for this imbalance in the local vapor pressure. This imbalance of the local pressure may not exist if all geometric, physical, technological and constructive or regime factors for adjacent branches are absolutely identical. It is natural to consider that if the scale of the differences is not considerable then as a result the driving forces are low as well, and thus, it may be may be difficult to ensure the intensive and stable periodical two-phase flow movement of the heat carrier from the heating to cooling zones and back. With this understanding of the physical nature of the driving forces in the PHP, the main idea of the present invention uses different forms of the artificial thermo hydraulics irregularity to influence the thickness of the liquid micro layer and the length of time that it last. The proposed method of action of the pulsating heat pipe (PHP), its construction and the devices are based on having alternating liquid and vapor slugs through out the tubes.

It is known that it is possible to have slug structure in the small diameters of tubes (less than 5 to 10 mm). The experimental results determined that there are limitations for the internal diameters of the d tubes and limitations for lengths of the slugs, which are connected with filling of the heat carrier fluid into the PHP. These physical limitations are a design consideration in realizing the suggested method of action of the pulsating heat pipe. There are limited conditions, where the PHP will work. They are such ranges of the relative radius of a tube R*k or the relative equivalent radius of the slug R*sl, when the alternating vapor and liquid slugs exist independently from any conditions of movement of two-phase flow of the heat carrier (for example, even if external average velocity of two-phase flow equals zero). If internal cross-section area sizes of the PHP branches (or R*k) and the filling of the internal volume of the PHP by the heat carrier (including ratio between vapor and liquid) are chosen with respect to the above mentioned conditions, the reliable action of the PHP can be accomplished. The conditions needed for the PHP to work require the, (see FIG. 1*a*), maximum relative radius R*k of the said tube is corresponding the condition:

$R^*k<2.2$, where $R^*k=R^*k/\sqrt{\delta/g\Delta\rho}$, and where the minimum relative length of the slug R*sl will not be lower than $R^*sl\geqq 1.5-2.0$, where $R^*sl=Rsl/\sqrt{\delta/g\Delta\rho}$ and $Rsl=[3Vsl/4\pi]$.

Where:

R*k—the relative radius of a tube,

R*sl—the relative equivalent radius of the slug,

Rk—the radius or equivalent radius of a tube,

δ—the surface tension, g—the gravitation acceleration,

Δρ—the difference of densities between of liquid and vapor of the heat carrier,

Vsl—the volume of the slug,

π=3.14.

Figure 2:
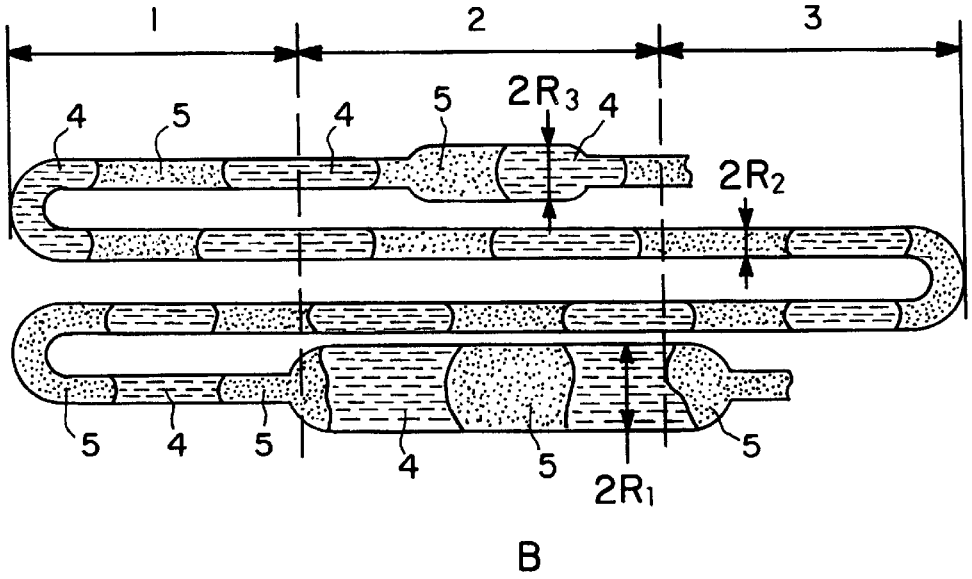
FIGS. 2*a* and 2*b* illustrate the PHP, wherein the branches of the tubes have different geometry, where there are changes in the main sizes of said branches
Figure 2:
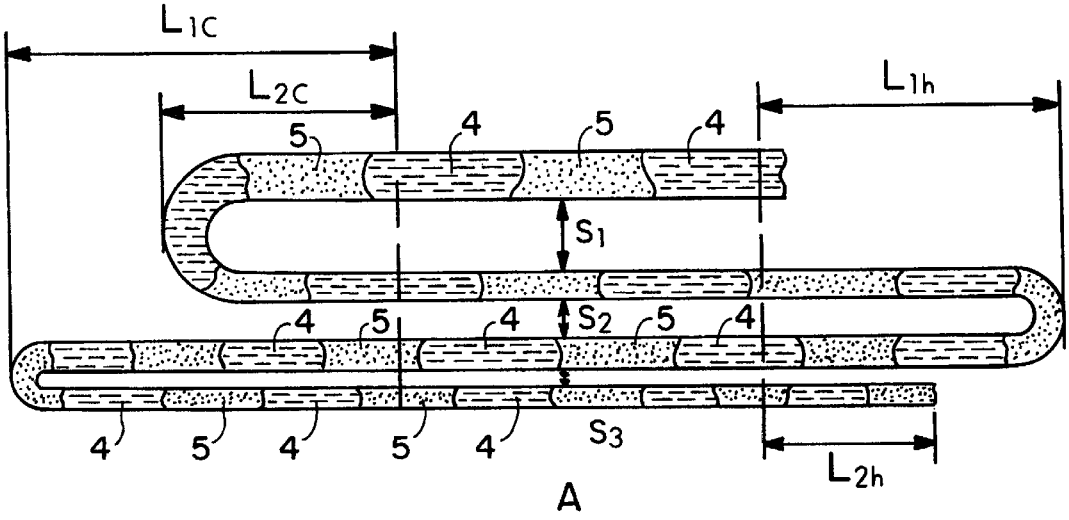

FIG. 2 illustrates the pulsating heat pipe action for the above-described method, wherein the branches of the tubes have different geometry, and where there are changes in the main sizes of said branches (FIG. 2*a*: lengths L1*c*, L2*c*, L1*h*, L2*h* . . . , pitches S1, S2, S3 . . . and FIG. 2*b*: radiuses R1, R2, R3 . . . ).

It is important to note, that any variant of the differences in the main geometrical parameters of the PHP branches such as lengths of the cooling, transport and heating sections—L1*c*, L2*c*, L1*h*, L2*h* . . . , or the internal radiuses of the tubes—R1, R2, R3 . . . , or the pitches (spacing) between the branches—S1, S2, S3 . . . can bring its own input to enforce the thermo hydraulics irregularity for process of the local heat and mass transfer between the heat carrier and surface of the tube. This result improves periodical two-phase flow circulation of the heat carrier and increases total efficiency of the PHP. Different deviations of construction materials in the geometrical parameters can stimulate the corresponding pressure imbalance in the adjacent branches in the small scale. When the deviations in the geometrical sizes are created artificially, it will enforce the pressure imbalance (thermo hydraulics discontinuity) and amplitudes of the driving forces, which in turn will enforce periodic movement of two-phase flow, which enhances the process of heat and mass transfer. Alternately, with additions of elements, which can accumulate mechanical energy of the pressure pulsation in the PHP and return it to two-phase flow, the flow can be stabilized. This principle is realized in variants of design of the suggested PHP are shown in FIGS. 3–6.

Figure 3:
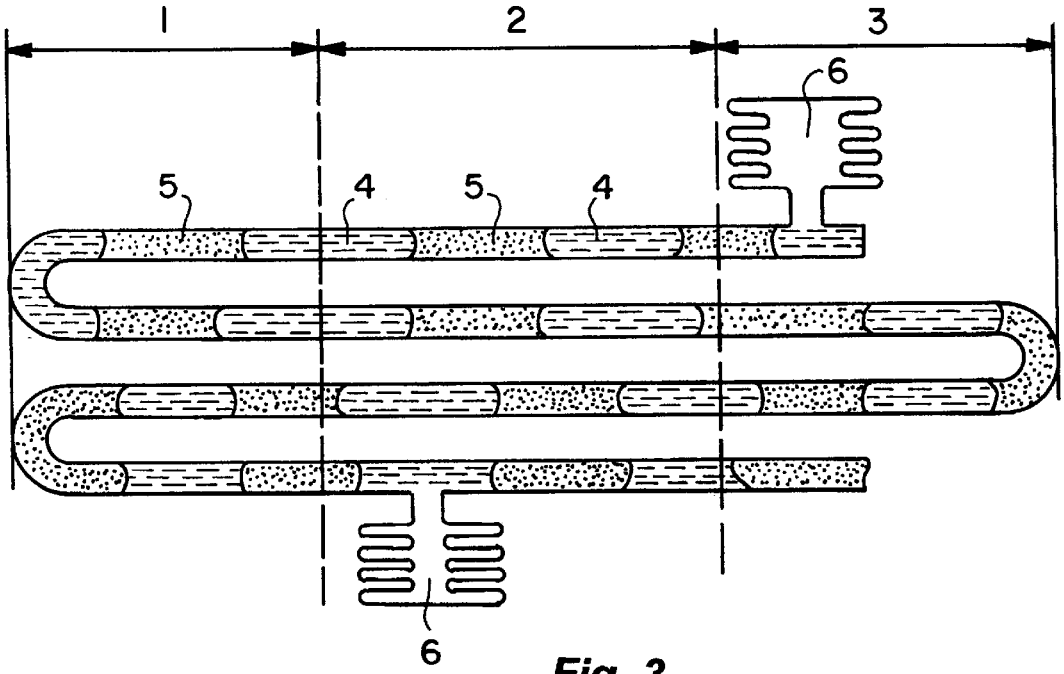
FIG. 3 illustrates the acting PHP with at least two bellows 6 (as example) and with two-phase flow of the heat carrier inside the PHP in the form of the liquid 4 and vapor 5 alternating slugs.

In FIG. 3 it is shown a PHP embodiment, with the alternating liquid 4 and vapor 5 slugs, sections for the cooling 1, transport 2 and heating 3 sections and also two bellows 6. One bellow 6, for example, is located in the end of the first heating section 3, the other can be located in any transport section 2. The number of the bellows 6 can be different. There will be pressure oscillations. These pressure oscillations are related to the "individual" mechanism of the PHP action in a localized portion. Where there is coincidence and resonance of pressure variation by multiple cells, we obtain a high amplitude of pressure. The bellows 6 will reinforce the positive peaks for small and high-pressure amplitudes. When the local or general pressure inside the PHP begins to grow, the bellows 6 begin to stretch out and mechanical potential energy of the pressure will be transformed and stored into the mechanical energy of the stretched bellow(s) 6. This process can accommodate pressure growth in the heating section 3 that is not compensated by the pressure decreasing in the cooling section 1 due to condensation. When the fluctuations of pressure change and average static pressure in the different branches or in the whole PHP begins to fall, then the stretched bellows 6 will return to its original position with supplementation of pressure of the two-phase flow. The stored mechanical energy ensures the reliable return of the liquid heat carrier fluid into the heating section 3. The sizes of the bellows 6 are such that the maximum volume created by the maximum pressure would be enough to compensate the corresponding increasing of the internal two-phase flow volume and restore the average volume of the bellow 6. The action of the bellow 6 stabilizes and improves reliability of the action of the PHP.

Figure 4:
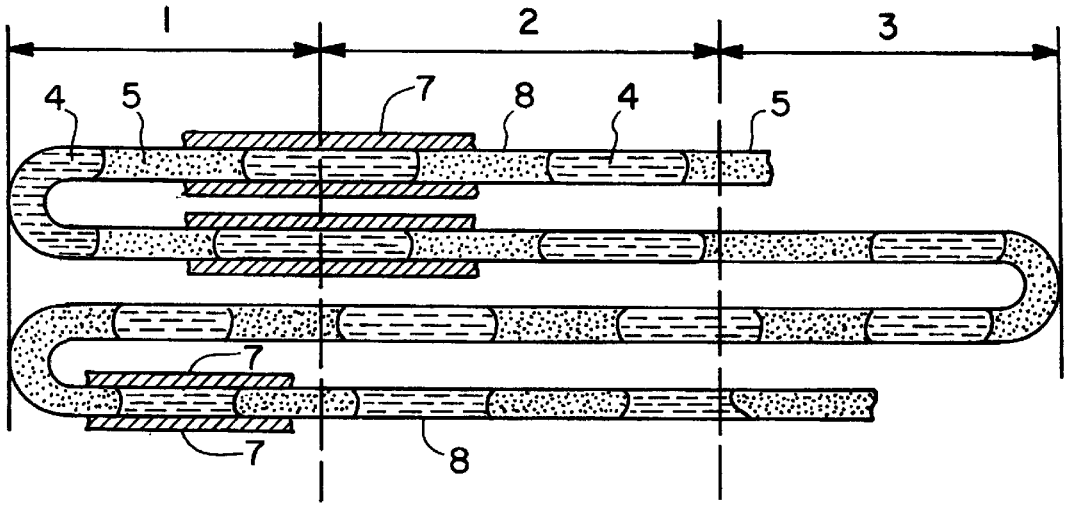
FIG. 4 illustrates the PHP with two interacting adjacent branches, which contain the sealed parts of walls 8, produced from rubber or another elastic material 7, with liquid 4 and vapor 5 slugs of two-phase flow in internal volume of the PHP.

FIG. 4 illustrates the PHP with cooling 1, transport 2 and heating 3 sections, which are filled by alternating liquid 4 and vapor 5 slugs. This PHP has, for example, two interacting adjacent branches, which contain the sealed parts of walls 8, produced from rubber or another elastic material 7, with liquid 4 and vapor 5 slugs of two-phase flow in internal volume of the PHP. This PHP accumulates the mechanical energy by internal pressure fluctuations expanding the elastic material 7. Joining of the elastic material is such as to prevent damage. These additional pieces of the elastic material 7 can be installed in any place. For example, in one of the PHP tailpieces. These pieces of the elastic material 7 fulfill the same function of the bellows 6, when local or total pressure level begins to grow and the cross-section sizes of these pieces begin to increase and accumulate mechanical energy of two-phase flow. As soon as local pressure begins to fall, the accumulated mechanical energy returns to phase flow.

Figure 5:
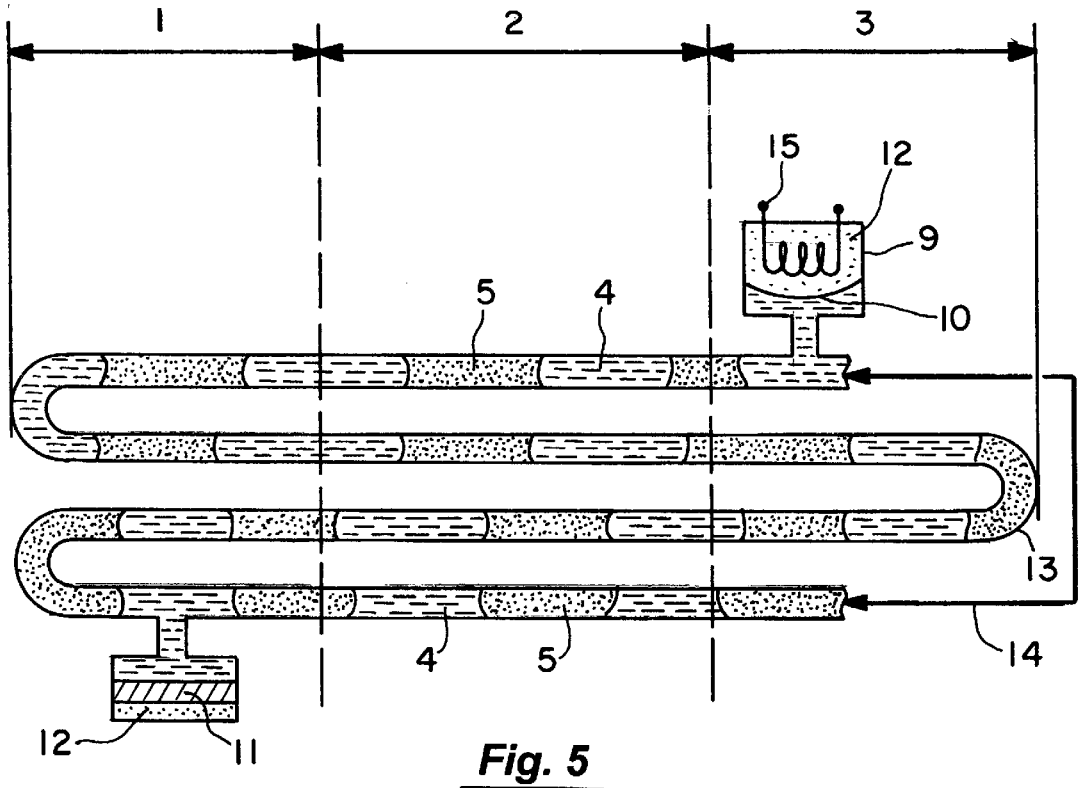
FIG. 5 illustrates the PHP with the serpentine branches 13 and the sealed vessels 9 contain noncondensable gas 12, membrane 10 or piston 11. The PHP is filled by two-phase flow of the heat carrier consisted from alternating liquid 4 and vapor 5 slugs. This PHP can contain the bypass line 14.

FIG. 5 illustrates the PHP with the serpentine type of the branches 13 and the sealed vessels 9, which contain noncondensable gas 12, membrane 10 or piston 11. This PHP is filled by two-phase flow of the heat carrier comprised from alternating liquid 4 and vapor 5 slugs. The PHP (see FIG. 6) with additional volume 16 and heater 15, which partly is filled by liquid 17. The heater 15 can be with a control system. This PHP is filled by two-phase flow of the heat carrier made from alternating liquid 4 and vapor 5 slugs. Here (FIG. 5) noncondensable gas volume 12, present in the vessel 9, simultaneously with the liquid volume 4 but is divided from it by the membrane 10 or moving piston 11. There is no leakage of gas or liquid over membrane 10 or piston 11. This PHP can contain the bypass line 14.

Figure 6:
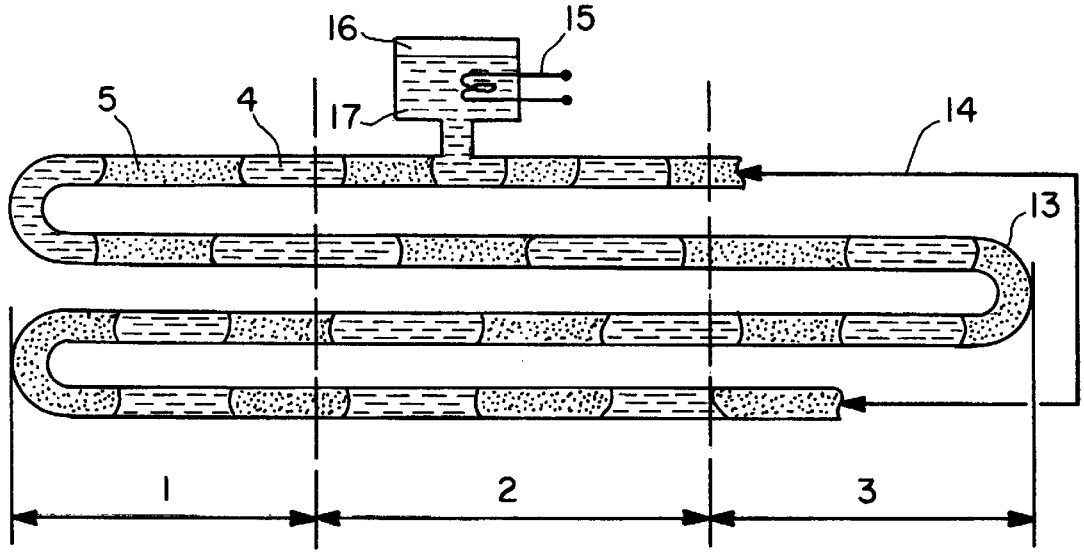
FIG. 6 illustrates the PHP with additional volume 16 and heater 15, which partly is filled by liquid 17. Heater 15 can be joined with a control system. The PHP is filled by two-phase flow of the heat carrier consisted from alternating liquid 4 and vapor 5 slugs.

The PHP, is shown FIG. 6, contains the heater 15, which is used for control of the pressure level of the two-phase heat carrier in the additional volume 16, for control of the mechanical energy accumulation from pressure pulsation and for stability of periodical movement of the two-phase flow.

Figure 7:
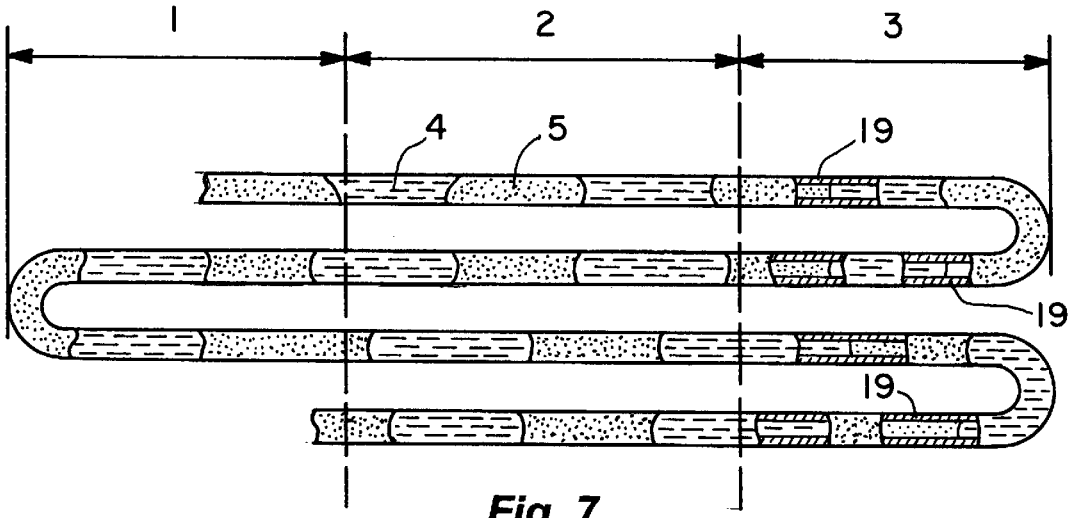
FIG. 7 illustrates the PHP with periodical coatings (porous covering) 19 on the heating section 3 of internal surface. The places with coatings 19 are alternated with smooth places.

FIG. 7 illustrates the PHP with at least one internal coating creating a porous surface, 19 on the heating section 3. The places with coatings 19 are alternated with smooth surface areas. The porous or rough coatings 19 allow more liquid accumulation on the surface of the heating section 3 in comparison with adjacent smooth parts. These parts can accentuate the thermal hydraulic discontinuity and as a result enforce two-phase flow movement and enhancement of heat and mass transfer.

Figure 8:
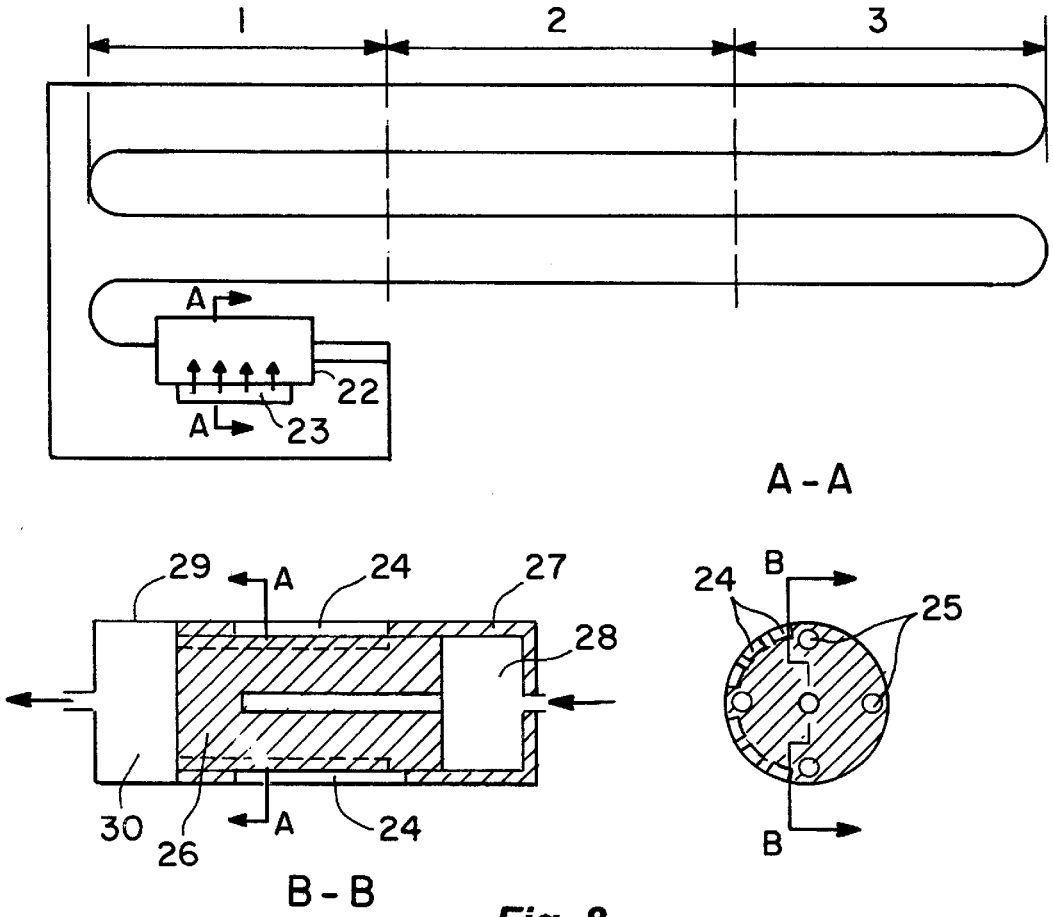
FIG.8*a* illustrates the PHP with porous insert 22 and additional heater 23 (from hot flow, electric heater etc.), where cross-sections A—A and B—B illustrate: 24—azimuth channels, 25—axial channels, 26—main porous structure, 27—auxiliary porous structure, 28—compensation volume, 29—container wall and 30—outlet chamber.

FIG. 8 illustrates the PHP with porous insert 22 and additional heat source 23 (from hot fluid flow, electric heater etc.), where: 24—azimuth channels, 25—axial channels, 26—main porous structure, 27—auxiliary porous structure, 28—compensation volume, 29—container wall and 30—outlet chamber. The porous insert 22 is filled with the same fluid as the tubes, and it contains the azimuth channels 24 near the container wall 29 and the axial channels 25. The main porous structure 26 is filled by liquid, which is transported from compensation volume 28 by the auxiliary porous structure 27. It causes evaporation of liquid under action of the heat flux from some additional heat source 23, which is primarily on porous insert 22. Evaporation is occurring in the area of thermal contact between the porous insert 22 and the container wall 29 near the azimuth channels 24. Vapor, from evaporation, moves into the azimuth channels 24, then it collect in the axial channels 25. Afterwards, it moves to the outlet chamber 30. During the stable evaporation process from the wetted porous structure, there is capillary pressure due to the difference between vapor pressure on the phase border in the curved meniscus and liquid under this phase border. Difference in pressure can reach many thousands Pascal and can be used to enforce two-phase flow movement and stabilize the action of the PHP. It improves the main characteristics of the pulsating heat pipe.

Figure 9:
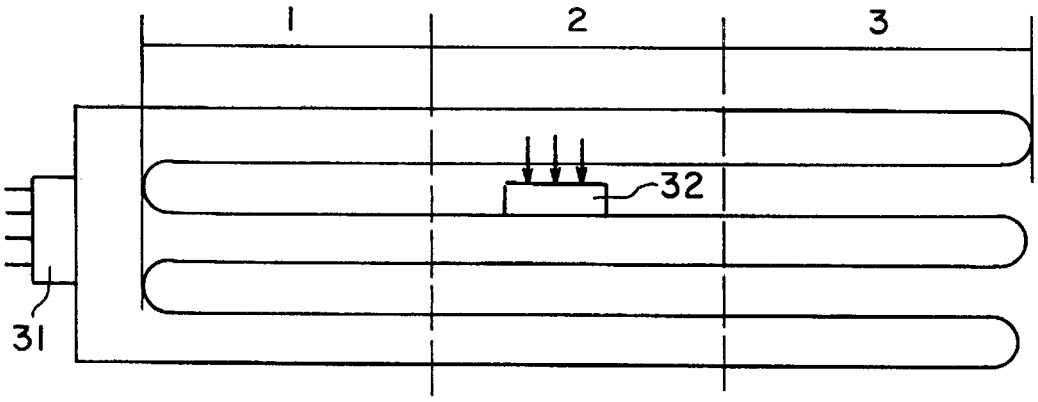
FIG. 9 illustrates the PHP, wherein there are additional heaters 31 and 32, which are working periodically.

FIG. 9 illustrates the PHP wherein there are additional heaters, 31 and 32, which are working periodically. The tube contains at least one auxiliary heater 31 or 32 of the periodical action on the transport 2 or/and cooling 1 sections. The auxiliary heater location, which acts periodically, guarantees the liquid presence in the location of the auxiliary heater. When, for example, heater 31 is on inside the tube is a growing vapor slug 5, which is pushing in both sides of two-phase flow. As soon as the heating process has stopped, the condensation process begins and it leads to changing of the direction of movement of two-phase flow. Therefore it becomes possible to enforce the two-phase periodical movement of the heat carrier in the PHP and correspondingly to obtain enhancement of the heat and mass transfer characteristics.

Figure 10:
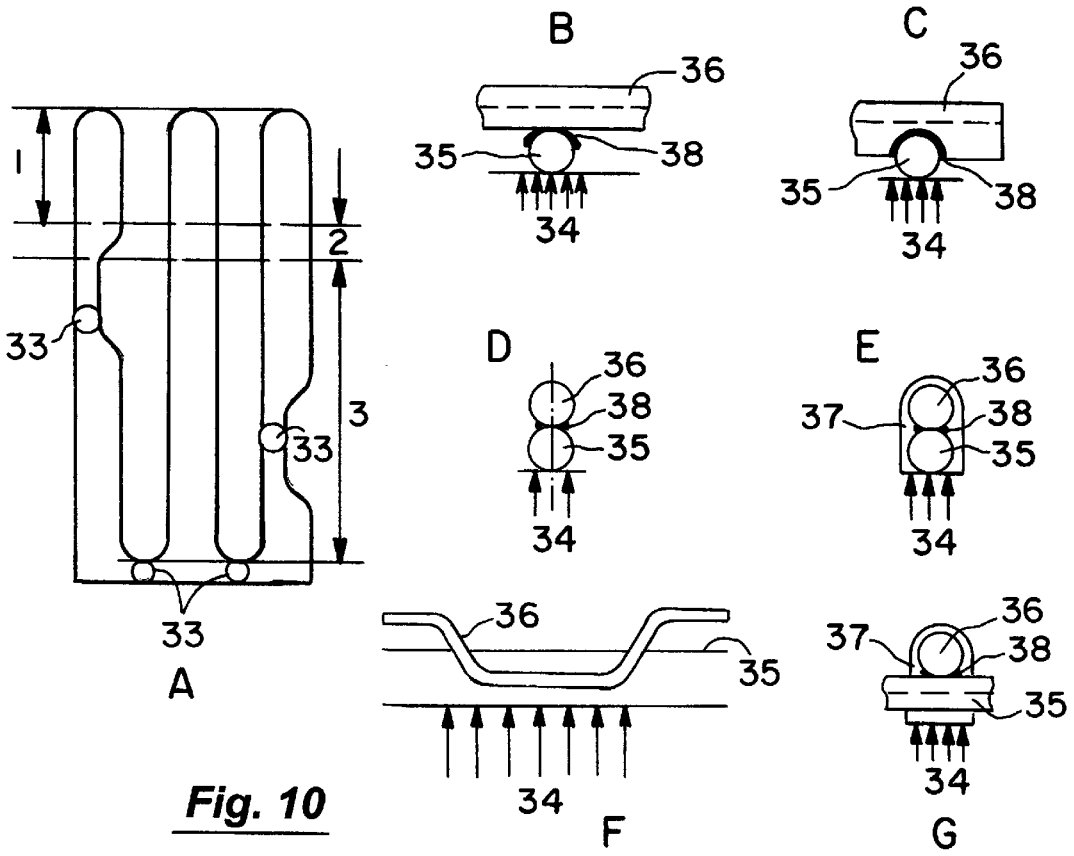
FIGS. 10*a–g* illustrate the PHP, wherein the parts 33 with the heat input 34 of some branches of the tubes have on the parts 35 and 36 of their surface reliable thermal contacts 37 and 38 with the cooling 1 or/and heating 3 sections of the another branches of the tubes.

FIG. 10 illustrates the PHP, wherein the parts 33 with the heat input 34 of the some branches 37 and 38 of the tubes have on 35 and 36 of their surface reliable thermal contacts with the cooling 1 or/and heating 3 sections of the another branches of the tubes. This pulsating heat pipe uses reliable thermal contacts on the external surfaces of the connected parts of the different branches (see FIG. 10*b, c, d, e* and *g*). The corresponding part of one branch is inside the corresponding part of another branch (see FIG. 10*f*). In the last cases, when the corresponding part of one (main) branch becomes superheated (as the result of disappearance of liquid microfilm of the heat carrier), then this part, which has the reliable thermal contact with any part of another branch, begins to play a role of the additional source of heat for this branch (auxiliary). It will stimulate the two-phase movement and improvement of corresponding heat and mass transfer characteristics. There are different possible forms (see FIG. 10*a–g*) of these contacts (37 and 38) for different branches, which are shown in FIG. 10.

Figure 11:
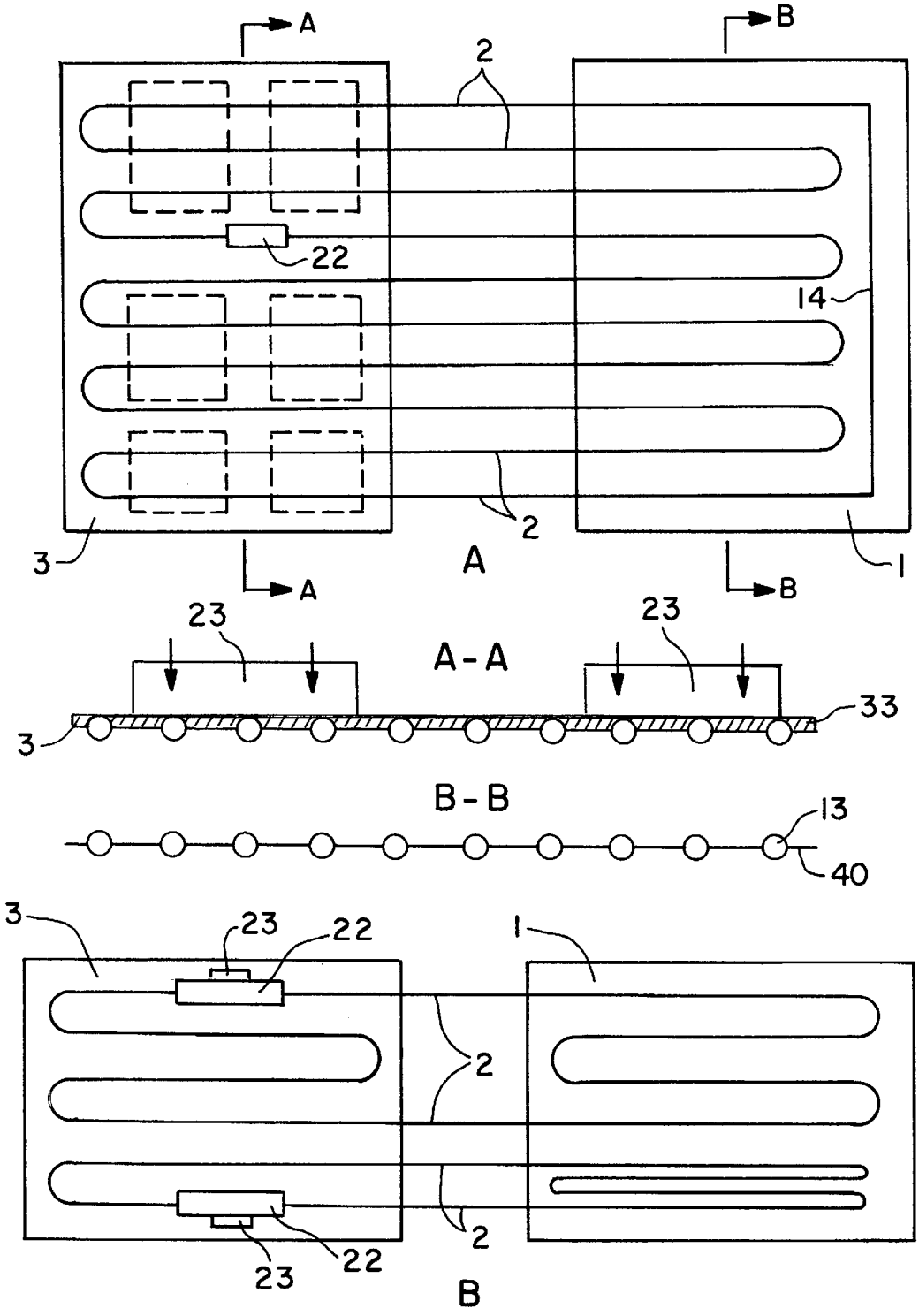
FIGS. 11*a* and 11*b* illustrate the PHP, wherein the cooling 1 and heating 3 sections have the locations on the different panels, which can change their relative position through the flexibility of the transport section 2 of the PHP and cross-sections A—A and B—B.

FIG. 11 illustrates the PHP, wherein there are at least one porous insert 22 and additional heater 23 (the same like in FIG. 8). Here the cooling 1 and heating 3 zones are located on the separate panels 40 and 39, which can be oriented in different planes. The relative position of these panels can be changed through the flexibility of the transport zones 2. This type of the PHP is combined with porous insert 22 and can be used both for gravity conditions and space applications for heat rejection, when panel 40 with the cooling zones 1 will play a role of the radiator.

This invention uses the thermo hydraulics discontinuity as an efficient method of action of the PHP. Normally the thermal and hydraulic discontinuities are considered to be disadvantages. This invention uses these discontinuities as a positive force for the action of the PHP.

The selection of the tube material, the tube size, the heat carrier (working fluid), and the portion of the total volume to be filled with the heat carrier are set forth. These are embodiments based on available products. Future materials and compounds will by extension address the same mechanism and methods to accomplish these ends.

The selection of heat carrier is dependent upon the operating temperature range. For a given range there may be two or more possible heat carriers that have boiling and thus, condensation temperatures that work well with and coincide with the target operating temperature. It is desired that the selection of the heat carriers, because of the aforesaid target operating temperature, will aid in the operation of the heat pipes by creating a pressure inside the pipe greater than that pressure existing on the outside of the pipe. This positive pressure helps with the integrity of the heat pipe mechanism by inhibiting leakage into the heat pipe.

The materials may be any liquid in the operating temperature range.

As embodiment in ranges the following are suitable and preferred heat carriers:

| Temperate Range | Heat Carrier |
|---|---|
| −30° C.–+30° C. | ammonia or liquid with similar boiling point, such as refrigerants |
| −30° C.–180° C. | ammonia and water with the mixture depending on the boiling point desired |
| 80° C.–300° C. | water or organic fluid |
| 200° C.–300° C. | organic liquids |
| >600° C. | liquid metal, such as Lithium or Sodium |

The selection of the heat carrier then helps to decide the material for the heat pipes, as some carriers and pipes are compatible and some are not. The factors are corrosiveness and mechanical strength limits due to pressures involved.

For water any heat pipe but aluminum will do for corrosiveness. For ammonia and refrigerants, plastic, aluminum and stainless steel are suitable for non-corrosion, but not copper. For the higher temperatures plastic is not suitable, though future products and developments will allow higher temperatures. For liquid metals, stainless steel or other suitable metal with high strength in the operating ranges will be necessary.

A second consideration for pipes will be the mechanical strength. In some applications the vapor pressures, combined with the operating temperatures, will prohibit certain materials.

Plastic generally will not be useable if the pressures are too great.

For Teflon, up to a temperature of 400° C., the pressure should not be greater than 10 bars.

Polypropylene has a useable range up to 200°–300° C. with a pressure of 10–20 bars. Most common plastics are adequate for up to 100° C. and 4–5 bars.

Apart from the corrosion, mechanical strength and temperature range consideration, there are other advantages to be considered.

Water as a heat carrier has superior characteristics in the latent heat capacity and thus, has a vast reservoir of heat carrying capacity plastic, such as Teflon has the ability to minimize surface tensions and thus, more readily allow the micro layer of liquid to boil into vapor.

Additional advantages of plastics are the ability to expand and contract, thus, storing and releasing potential energy.

The sizing of the piping is variable. The diameter of wall thickness is approximately 0.1×diameters.

The amount of heat carrier to add to the heat pipe is dependent upon the hot and cold areas and their sections respective volumes. The $V_{op}$ or operation volume of heat carrier is $0.5(V_{h+Vc})<V_{op}\geqq(V_h+V_c)$ $V_h$=volume of hot sections $V_c$=volume of cool sections.

If there is no transport zone in a particular use, the equation simplifies to $$0.5V_o \leqq V_{op} < 0.8V_o$$

where $V_o$ is the total internal volume of the heat pipe.

I claim:

1. The pulsating heat pipe apparatus comprising: a) continuous tube, b) formed as a system of branches with a cooling, a transport and a heating section to allow movement of the liquid and vapor slugs of the heat carrier, d) where maximum relative radius R*k of the said tube is corresponding the condition:

$$R^*k<2.2, \text{ where } R^*k=Rk/\sqrt{\delta/g\Delta\rho},$$

(e) and where the minimum relative length of the slug R*sl will not be lower than $$R^*sl \geq 1.5\text{-}2.0, \text{ where } R^*sl = Rsl/\sqrt{\delta/g\Delta\rho},$$

and $Rsl=[3Vsl/4\pi]$,

Where:

R*k—the relative radius of a tube,

R*sl—the relative equivalent radius of the slug,

Rk—the radius or equivalent radius of a tube,

δ—the surface tension, g—the gravitation acceleration,

Δρ—the difference of densities between of liquid and vapor of the heat carrier,

Vsl—the volume of the slug, π=3.14.

2. The pulsating heat pipe according to claim 1, wherein the branches of the tubes have different dimensions of length and radiuses of tubes in the cooling and heating sections.

3. The pulsating heat pipe according to claim 2, wherein the tubes contain at least one bellow, which is joined within the tubes.

4. The pulsating heat pipe according to claim 2, wherein at least some parts of the branches of the tubes are made of elastic materials.

5. The pulsating heat pipe according to claim 2, wherein the tubes contain at least one sealed vessel with a liquid heat carrier with a noncondensable gas, and said vessel is joined to the tubes and divided from them by a barrier.

6. The pulsating heat pipe according to claim 5, wherein inside of the sealed vessel with the liquid heat carrier is installed a heater.

7. The pulsating heat pipe according to claim 2, wherein at least some of the internal surface of the tubes of the branches in the heating section has rough coatings alternating with smooth parts.

8. The pulsating heat pipe according to claim 2, wherein the tubes contain at least one porous insert with the azimuth and axial channels and heater.

9. The pulsating heat pipe according to claim 2, wherein the tubes contain at least one heater.

10. The pulsating heat pipe according to claim 2, wherein the parts of some branches of the tubes have on the parts of their surface reliable thermal contact with the cooling and heating sections of other branch of the tubes.

11. The pulsating heat pipe according to claim 8, wherein at least one of the heating sections of the tubes is located in one panel with the heater and at least one of the corresponding cooling sections is located in other panel with heat rejection means.

* * * * *